US011130609B2

(12) United States Patent
Aittamaa

(10) Patent No.: US 11,130,609 B2
(45) Date of Patent: Sep. 28, 2021

(54) BLANK FOR FORMING DISPOSABLE CUP AND DISPOSABLE CUP

(71) Applicant: Origamicup Oy, Jokioinen (FI)

(72) Inventor: Teemu Aittamaa, Jokioinen (FI)

(73) Assignee: Origamicup Oy, Jiokioinen (FI)

( * ) Notice: Subject to any disclaimer, the term of this patent is extended or adjusted under 35 U.S.C. 154(b) by 0 days.

(21) Appl. No.: 16/878,033

(22) Filed: May 19, 2020

(65) Prior Publication Data

US 2020/0369429 A1 Nov. 26, 2020

(30) Foreign Application Priority Data

May 21, 2019 (FI) ..... 20195415

(51) Int. Cl.

| | |
|---|---|
| ***B65D 3/20*** | (2006.01) |
| ***B65D 3/06*** | (2006.01) |
| ***B65D 3/26*** | (2006.01) |
| ***B65D 5/02*** | (2006.01) |

(52) U.S. Cl.

CPC ..... *B65D 3/20* (2013.01); *B65D 3/06* (2013.01); *B65D 3/268* (2013.01); *B65D 5/0209* (2013.01)

(58) Field of Classification Search

CPC . B65D 3/30; B65D 3/06; B65D 3/268; B65D 5/0209; B65D 1/265; B65D 81/3865

USPC ..... 229/138, 404, 128, 156, 4.5, 906.1; 220/200

See application file for complete search history.

(56) References Cited

U.S. PATENT DOCUMENTS

| | | | | |
|---|---|---|---|---|
| 8,864,015 | B2 * | 10/2014 | Lu | B65D 3/06 229/128 |
| 9,751,655 | B2 * | 9/2017 | Herman | B65D 3/06 |
| 9,845,173 | B2 * | 12/2017 | Herman | A47G 19/2205 |
| 2009/0114710 | A1 | 5/2009 | Lang | |

FOREIGN PATENT DOCUMENTS

| | | | |
|---|---|---|---|
| EP | 241026 | B1 | 5/1991 |
| EP | 1354804 | A1 | 10/2003 |
| JP | S62174015 | U | 11/1987 |
| WO | 0126980 | A1 | 4/2001 |

OTHER PUBLICATIONS

Finnish Patent and Registration Office, Office Action, Application No. 20195415, dated Nov. 29, 2019, 7 pages.
Finnish Patent and Registration Office, Office Action, Application No. 20195415, dated Mar. 22, 2021, 6 pages.

* cited by examiner

*Primary Examiner* — Christopher R Demeree
(74) *Attorney, Agent, or Firm* — Ziegler IP Law Group, LLC

(57) ABSTRACT

A blank 10 for forming a disposable cup, the blank including a cardboard sheet designed to be formed into a body of a cup, the blank including an edge 12 in a form of a first arc for forming the bottom edge of the cup, and a folding line for forming the rim of the cup, wherein the folding line for forming the rim of the cup contains a first folding line 14 formed by a plurality of interconnected arc-shaped folding lines 16 each arcing to the opposite direction than the first arc, and wherein a foldable wing 18 extends form each arc-shaped folding line, the wings being configured to be folded towards the center of the formed cup to lock onto each other to form a cover over the opening of the cup. The present application also provides a disposable cup formed from the blank, and a method for preparing a disposable cup.

17 Claims, 6 Drawing Sheets

BLANK FOR FORMING DISPOSABLE CUP AND DISPOSABLE CUP

FIELD OF THE APPLICATION

The present application relates to a blank for forming disposable cups, to a method for preparing a disposable cup, and to a disposable cup.

BACKGROUND

A disposable two-piece cup usually comprise a bottom, and a generally truncated conical body or liquid holding portion. A separate lid can be applied over the opening of the cup to cover the content of the cup. A cup including the body portion and the lid may be called as a three-piece cup. However, the use of disposable cups with separate lids may not be desired, as the lid is usually made of plastic, which may be poorly recyclable or otherwise undesired material, and the application of the lid may be unsure and makes the use of the cup complicated and inconvenient.

Some cups contain a folding lid in a two-piece design. However, such foldable lids cannot be usually secured well enough and may make the form of the cup inconvenient or even unsuitable for drinking. There is a need for simple, secure and easy to use solutions for forming a foldable lid to a disposable cup.

SUMMARY

The present application presents a solution for forming a disposable cup which can be covered without a separate lid or the like cover. It was found out how to prepare a blank which can be folded into a cup having an integral lid or cover, more particular a foldable structure which can be formed into a cover of the cup. The formed disposable cup may be called as capless or lidless cup, wherein the cap or the lid refers to a separate part. The foldable structure is self-supporting and further supports the body of the cup. The foldable structure is able to lock onto itself so the structure does not unfold easily. The structure allows using a regular straw as a support for the cover.

The present application provides a blank 10 for forming a disposable cup, the blank comprising a cardboard sheet designed to be formed into a body of a cup, preferably in a form of a truncated cone, the blank comprising a first edge 12 in a form of a first arc for forming the bottom edge of the cup, a folding line for forming the rim of the cup, wherein the folding line for forming the rim of the cup contains a first folding line 14 formed by a plurality of interconnected arc-shaped folding lines 16 each arcing to the opposite direction than the first arc, and wherein a foldable wing 18 extends form each arc-shaped folding line 16, the wings, preferably tips of the wings, being configured to be folded towards the center of the formed cup to lock onto each other to form a cover over the opening of the cup, wherein each of the foldable wings 18 extending form each arc-shaped folding line 16 are partly interconnected at the folding line 14 end forming a continuous area 20 between the first folding line 14 and a second edge 40 at the opposite end of the blank than the first edge 12, the continuous area 20 being in a form of an arc which is substantially parallel to the first folding line 14, wherein tips of the wings 18 extend from the second edge 40, and each of the foldable wings 18 contain at the continuous area 20 a first folding surface 22 formed by a second folding line 26 and a third folding line 28, the second and the third folding lines extending from the first end 30 and the second end 32 of each arc-shaped folding lines 16 and forming an angle ($\alpha$), such as an angle ($\alpha$) of 40-50°, wherein a tip of a wing 18 points away from the first folding line 14, and wherein the second folding line 26 and the third folding line 28 are formed to be able to fold to form the cover, preferably wherein a second folding line of a wing and a third folding line of an adjacent wing meet each other at an end of an arc-shaped folding line.

The present application also provides a disposable cup formed from the blank.

The present application also provides a method for preparing a disposable cup, the method comprising providing the blank, and forming the blank into a disposable cup.

The main embodiments are characterized in the independent claims. Various embodiments are disclosed in the dependent claims. The embodiments and examples recited in the claims and the specification are mutually freely combinable unless otherwise explicitly stated.

The plurality of interconnected arc-shaped folding lines enable forming a rim which is substantially ring-shaped so that cups with optimal cup forms may be obtained. The arcing direction of the plurality of interconnected arc-shaped folding lines further support the cover when formed. The arcing causes the foldable wings to point slightly below the plane of the rim, i.e. to inside of the cup, when the wings are in a "locked" position and the cover has been formed. This causes the foldable cover and the wings to lock into this position, so that the locking is not easily released and the cover stays folded and stable. The cup may be used and for example pressure may be applied to the cup without the risk that the formed cover would be opened or unfolded.

The cups may be used for holding liquids, suspensions and/or solids, which may be hot or cold, such as drinks, food products, such as soups, dressings, sauces, salads, meat, fish, vegetables, ice cream, shakes, or food portions containing one or more thereof. Also other products may be provided and/or stored in the cups, such as dry or wet chemicals, decorative products, paint, glue, and the like material which is to be covered and wherein the spillage, evaporation, drying or contamination thereof should be prevented. As the covering part is an integral part of the body of the cup, the barrier properties of the cup, such as water and/or fat barrier properties, are also obtained at the cover part and the whole product may be implemented by using the same materials.

DETAILED DESCRIPTION

In this specification, percentage values, unless specifically indicated otherwise, are based on weight (w/w). If any numerical ranges are provided, the ranges include also the upper and lower values. The open term "comprise" also includes a closed term "consisting of" as one option.

The present disclosure provides a blank 10 for forming a disposable cup, the blank comprising a cardboard sheet designed to be formed into a body of a cup, or more particularly the blank is cut from a cardboard sheet, wherein the sheet designed to be formed into a body of the cup is formed. The body of the cup may be in a form of a truncated cone, but it may be also in a form of a cylinder or another suitable shape. Preferably the bottom and the top or the rim of the cup has a circular or round shape or substantially circular or round shape, which may allow a plurality of large angles especially at the rim of the cup.

Figure 1:
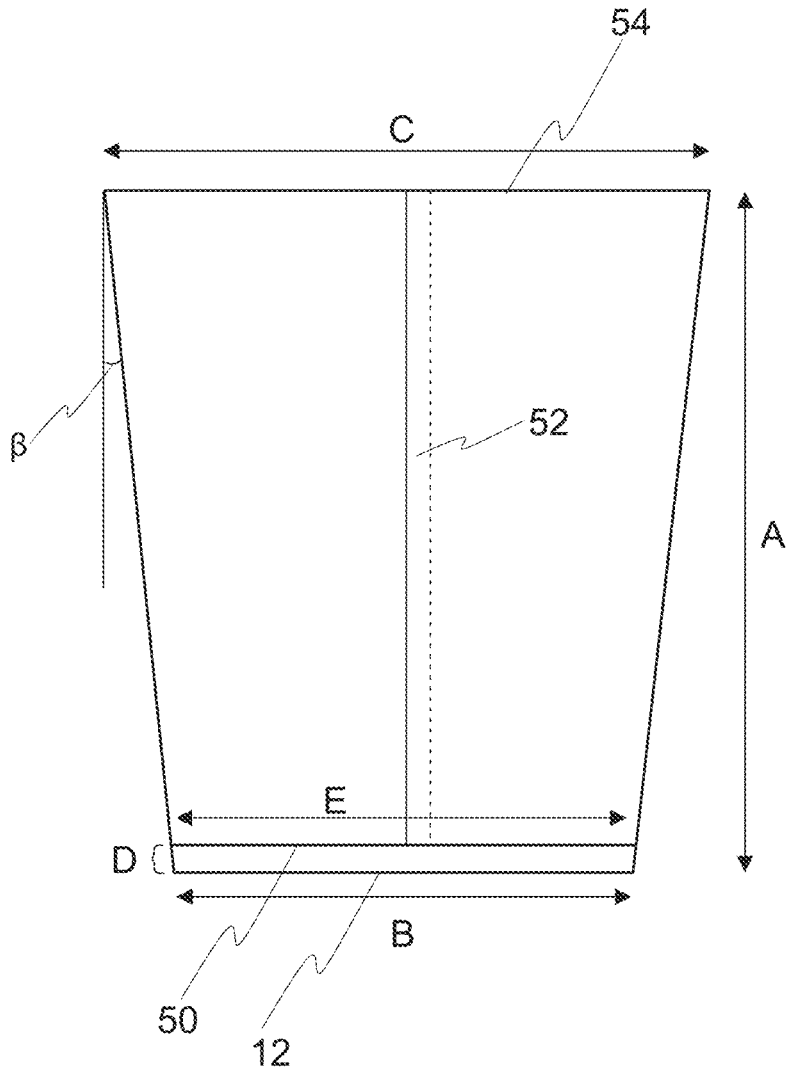
FIG. 1 shows a schematic view of a two-piece cup

An exemplary disposable cup is presented in FIG. 1 having a height A, bottom outside diameter B and rim 54 outside diameter C. The bottom includes a bottom edge 12, and a bottom piece 50, which is formed from a different part than the body of the cup and is at a distance from the bottom edge 12 of the cup, also called as the bottom depth D. The body of the cup is formed by joining two side edges to form a seam 52, having a width corresponding to the width of the overlapping area. The inner diameter of the bottom above the bottom piece 50 is called a mandrel diameter E. The angle of the side of the cup with the vertical axis of the cup or with a vertical line, when the cup is in an upright position, is called cup angle β, and it may be in the range of 0-30°, such as 0-20° or 0-10°, or 1-20° or 1-10°, so the truncated cone shape is obtained. The thickness of the body, which corresponds to the thickness of the blank 10, may be called sidewall caliper. Similarly the thickness of the bottom piece 50 may be called bottom caliper.

The blank comprises or is formed of basis material, such as cardboard, paperboard, paper, plastic, composite material or the like suitable material, which may be provided as a sheet. The "cardboard" as used in the present description also includes the other basis materials and/or they may be used interchangeably. Suitable basis materials include materials exhibiting similar properties as cardboard, such as required rigidity and stiffness but also elasticity and flexibility which enable to formation, function and use of the cup. For example the basis material shall allow the folding of the required structures and locking of the wings together during the use. Also in the case of straw it is desired that the basis material provides required friction, flexibility, elasticity, rigidity and other necessary properties to allow the straw to support the locking of the cover via the straw hole when inserted.

The blank may be coated or noncoated, such as coated cardboard, paperboard or paper. The coating may comprise for example plastic, such as one or more thermoplastic polymer(s), and/or it may comprise one or more compostable and/or biodegradable polymer(s), such as starch, cellulose, wax and the like polymeric material or combinations thereof, such as natural polymer(s) or other coating material(s) such as inorganic fillers, for example kaolin, mica and the like. The coating may provide barrier properties, so the basis material of the blank, for example in the case of cellulosic-based materials such as boards and papers, can be made impermeable to liquids, fats, alcohol, or the like. The coating may be fully or partly hydrophobic. Preferably the material of the blank is recyclable, or even compostable. The blank may have a thickness or a caliper in the range of 0.2-1.0 mm, such as 0.2-0.5 mm.

In one embodiment the blank is made from recyclable cardboard, preferably from compostable and/or biodegradable cardboard. The recyclable cardboard may be noncoated or coated with one or more recyclable polymer(s), such as compostable and/or biodegradable polymer(s) and/or other coating(s). This enables recycling the whole cup including the cover part which is made of the same material as the body of the cup. Also the recycling is simple as there is no need to separate the cover or to put different parts of the cup into different recycle bins.

The blank may be manufactured by providing a sheet of basis material, and cutting the sheet into a desired shape to obtain the blank disclosed herein. The cutting may be carried out by die-cutting.

A plurality blanks cut into desired shapes may be stacked on top of each other to facilitate packing, storing, handling, transporting, delivering and/or providing the blanks as intermediate products. The blanks may be manufactured at a first location and transported to a second location wherein the cups are formed from the blanks. The blanks may be provided as packed products, wherein a packing may comprise a plurality of blanks. If the blanks are coated, printed or otherwise surface-treated, this treatment may be carried out before cutting the blanks, or after cutting, and/or at the first location or at a second or a third location. For example it is possible to provide precoated or preprinted sheets of basis material for forming the blanks, or the formed blanks may be transported to a third location for coating, printing and/or for other treatment.

The blanks disclosed herein are designed to form a cup and a cover of the cup. The blanks contain foldable parts, such as wings, which may be folded to from a cover to the cup. When the foldable parts are in a desired position to form the cover, the cover, the wings, the foldable parts and/or the structure may be considered as "locked", formed, covered or combination thereof. This position or form may be also considered as the final or the second form or position, whereas the position or form, wherein the body of the cup is formed but not covered, may be called as the initial, the starting or the first form or position.

The blank comprises a first edge 12 in a form of a first arc for forming the bottom edge of the cup, and a folding line 14 for forming the rim of the cup. The first edge is at the first end of the blank, and the folding line is near the second edge of the blank, which is an opposite edge to the first edge. The third and fourth edges of the blank are substantially perpendicular to the first and second edges, however because of the required shape of the blank to form a cup having a shape of a truncated cone, in such case the blank does not have 90 degree angles, as can be seen for example in FIG. 2, but the angle of the first or second edge and the third or fourth edge may be for example in the range of 70-110 degrees. Therefore the expressions "perpendicular" and the like in the case of such blanks refer to rough directions and relations of the edges or other parts of the blank. When the cup is formed, the first edge is at the bottom or the lowest part of the cup, and the second end is at the top or the upper part of the cup. "Upper" or "lower" as used herein refer to the directions of a final cup sitting on a support, such as a table, i.e. during the normal use. The blank has a height, which comprises a length in a first direction, i.e. in the direction between the rim and the bottom, which is substantially the vertical direction when the cup is formed and placed on a support on its bottom. Correspondingly the blank has a width, which comprises a length in a second direction, i.e. in the direction between the third and fourth edges of the blank, which edges are designed to be joined together to form the body of the cup. The term "arc" and correspondingly the verb "arcing" refer to arc-shaped or curved forms, and also term "arch", "arching", "curve" and "curving" may be applied.

The blank is formed into the shape of the cup, such as the truncated cone. The third and fourth edges are joined together, for example by using a suitable adhesive, preferably to overlap to form a seam, and they are at an approximately vertical position during the use. A bottom piece may be provided, which may be circular or substantially circular, and it may comprise the same material as the blank or the body of the cup. The bottom piece fills the aperture formed by the first edge. The bottom piece may be joined to the body of the cup to obtain a two-piece cup, for example as presented in FIG. 1.

Figure 7:
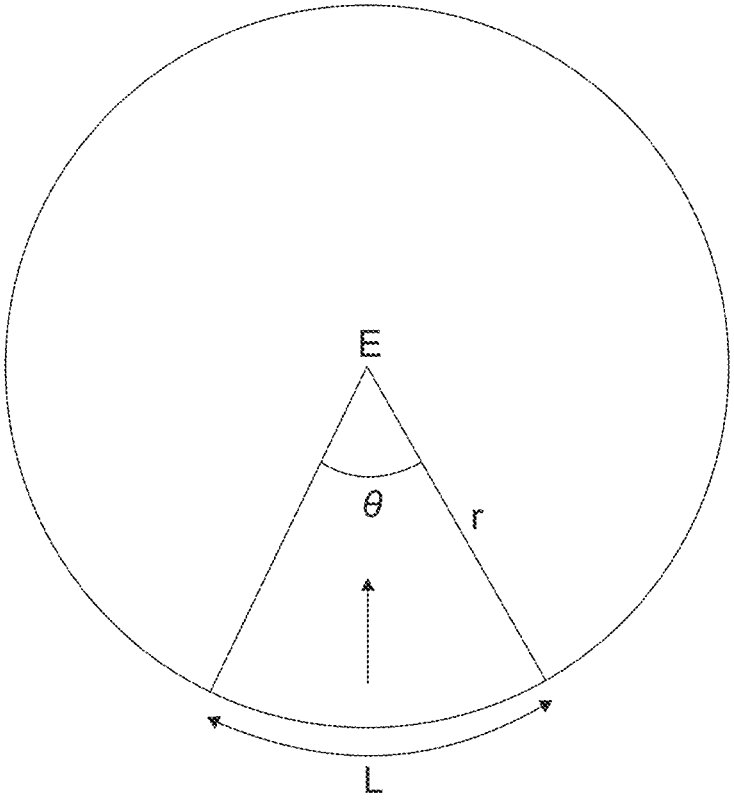
FIG. 7 shows a diagram explaining the angle θ of a circular arc

The folding line for forming the rim of the cup contains a first folding line 14, such as a first general folding line, formed by a plurality of interconnected arc-shaped folding lines 16 each arcing to the opposite direction than the first arc, which is formed by the first edge 12. More particularly the separate arc-shaped folding lines 16 are connected together at the ends to form an wavelike first folding line 14. The arc-shaped folding lines 16 may each have a shape of a segment of a circle so each of them may form a circular arc, more particularly minor arc. The arc-shaped folding lines 16 may be also called as curved folding lines, rim-forming arcs, rim-forming arc-shaped folding lines, interconnected arcs or curves, or a combination thereof, An arc has a length L which is a length of an arc of a circle with radius r and subtending an angle θ (measured in radians) with the circle center calculated as $L=\theta r$. This is shown in FIG. 7, wherein the center E of the circle is the vertex of the angle θ. The vertex of the angle θ of each arc-shaped folding line points to the second end of the blank, whereas the corresponding vertex of the angle θ of the first end of the blank points to the opposite direction. The opening direction of an arc (shown with an arrow in FIG. 7) may be defined as the direction from the middle point of the arc to the middle point of the chord of the arc or to the vertex of the angle θ. Therefore the first arc opens outside from the blank, more particularly to the direction which corresponds downwards when the final cup is formed and is in a position for usage.

The plurality of interconnected arc-shaped folding lines 16 are arranged to form the rim of the cup substantially in a form of a circle. The number n of the interconnected arc-shaped folding lines 16 may be 3, 4, 5, 6, 7, 8, 9 or 10 or more, such as 3-30, 4-20, 4-10, 4-8, 4-6, 5-8, 6-10 or 6-8, for example. With more arc-shaped folding lines it is possible to obtain more circular rim or upper edge of the cup, but the width of a wing will also decrease, which may make each wing less rigid thus making it more challenging to obtain durable locking and rigid cover. Also folding the cover may become more complicated and require more time. Therefore in many cases it may be desired that the number n of the interconnected arc-shaped folding lines is 10 or less, such as 8 or less. On the other hand, if there are only few arc-shaped folding lines, each wing may be rigid and provide durable locking and stable cover, but the rim of the cup will be more angular. This however may not be a problem, especially when a straw or drinking/pouring aperture is applied or if the angle of each arc is selected to support the folding process and the structure of the final cup. In practical tests for example six wings was found to provide rigid and durable structure and also an acceptable appearance and usability. The length L of an arc-shaped folding line 16 measured from one end to another end i.e. along the chord of the arc, depends on the number n of the arc-shaped folding lines and the diameter of the rim, and in most cases it may be in the range of 1-8 cm, such as 2-5 cm, for example 3-5 cm. In one exemplary cup having six arc-shaped folding lines the length each arc-shaped folding line was 4.25 cm. In one example the number n of the arc-shaped folding lines is 5, which was found to be optimal for obtaining a stable and well handleable structure and good locking of the cover.

The diameter of the rim, such as the outer diameter C, may be for example in the range of 3-30 cm, such as for example 3-10 cm for drink cups and for example 10-30 cm for large cups or bowls for example for salads, popcorn and the like food products. The volume of the cup may be in the range of 0.1-3 litres, such as 0.1-0.6 litres for drink cups and 1-3 litres for the cups or bowls for food products.

A full circle has an angle of 360 degrees, or 2π radius. However, when 360 degrees is divided with the number n of the arc-shaped folding lines 16, for each arc-shaped folding line there would be an angle which may be too large to be used in practice in the cups. For example with a full circular rim each containing six arc-shaped folding lines 16 each arc-shaped folding line would have an angle of 60 degrees. Such a folding line would be however difficult to fold and it would cause crinkles and breaks along the folding line 14 and around it, and especially in the points 30 and 32. The risk of misfolding would be high. This is especially a problem when cardboard or the like cellulosic material, especially with a coating, such as a coating with barrier properties, are used. The coating may be for example a compostable or biodegradable coating, which may not tolerate such heavy folding. The folding may deteriorate the appearance of the cup and/or it may destroy the barrier properties of the material when the material and/or the coating breaks when folded. Further, if the arc-shaped folding lines 16 would have too broad angle, the folding of the cover would be not only difficult and require manual force, but it would also result in increased risk of misfolding and destroying the blanks. A misfolded or damaged blank may not be refolded to obtain an acceptable cup. This is important because the cup is usually already filled before folding the cover, especially filled with liquid. It is not acceptable for example in restaurants that the folding of a full cup would be difficult or it would result in an unacceptable folding. Further, if folding is difficult and requires special care, it will increase the time needed to obtain an acceptable folding. Therefore it was important to find suitable materials and form of the blank, such as forms of the folding lines.

It was found out that when using an angle θ of an arc in an arc-shaped folding line 16 less than 360 degrees or 2π radians divided with the number n of the separate arcs, the folding of the cover is easier, and the cup material is not damaged but the cover will be still locked properly. On the other hand the folding line 16 shall have certain arc-shape to obtain the locking and supporting properties, for example an arc having an angle θ of at least 5 degrees or 0.09 radians, but in most cases at least 10 degrees or 0.18 radians, or at least 15 degrees or 0.26 radians.

The subtending angle θ of an arc in the arc-shaped folding line 16 may be $2\pi/n$ radians or less (360°/n or less), preferably less than radians, for example $2\pi/n*1.1$ or less, or $2\pi/n*1.2$ or less, wherein n is the number of separate arcs 16 in the first folding line 14. The subtending angle θ of an arc in the arc-shaped folding line 16 may be however at least 2π/n*12 radians, or at least 2π/n*8 radians. The subtending angle θ of an arc in the arc-shaped folding line 16 may be in the range of 2π/n-2π/n*4 radians, such as 2π/n*1.1-2π/n*4 radians or 2π/n*1.2-2π/n*4 radians. In some cases the angle θ may be 2π/n*1.3-2π/n*4 radians or 2π/n*1.4-2π/n*4 radians, even 2π/n*2-2π/n*4 radians.

Therefore in a cup having six arc-shaped folding lines each subtending angle θ of an arc-shaped folding line 16 may be for example in the range of 0.26-1.0 radians or 20-60°, preferably 0.26-0.8 radians or 15-47°, more preferably 0.26-0.7 radians or 15-40°. If the subtending angle θ is lower than what is required to form fully circular rim, a rim with large angles is formed, which was found to enhance the rigidity of the formed cover structure. In such cases the rim is substantially circular. The angles disclosed herein may work best when the number of arcs is at least 4, at least 5, or at least 6, such as 6-12, 6-10 or 6-8.

The blank comprises a plurality of foldable wings, wherein a foldable wing 18 extends form each arc-shaped folding line 16, the wings, preferably tips of the wings, being configured to be folded preferably towards the center of the formed cup i.e. the center of the opening of the cup, more particularly towards the center of the aperture formed by the rim, to lock onto each other to form a cover over the opening of the cup. The wing may include a first part directly extending from the arc-shaped folding line, which first part may be a part of a continuous part or area comprising a plurality of fold lines and/or first parts. The wing may also include a second part, which comprises a tip of the wing extending from the first part and wherein the plurality of the second parts in the blank are separate from each other, i.e. they do not share a common continuous part. The border of the first part of the wings and the second part of the wings may form the second edge 40 or the second end of the blank. This border may form an arc arcing to the same direction as the first folding line 14.

Figure 2:
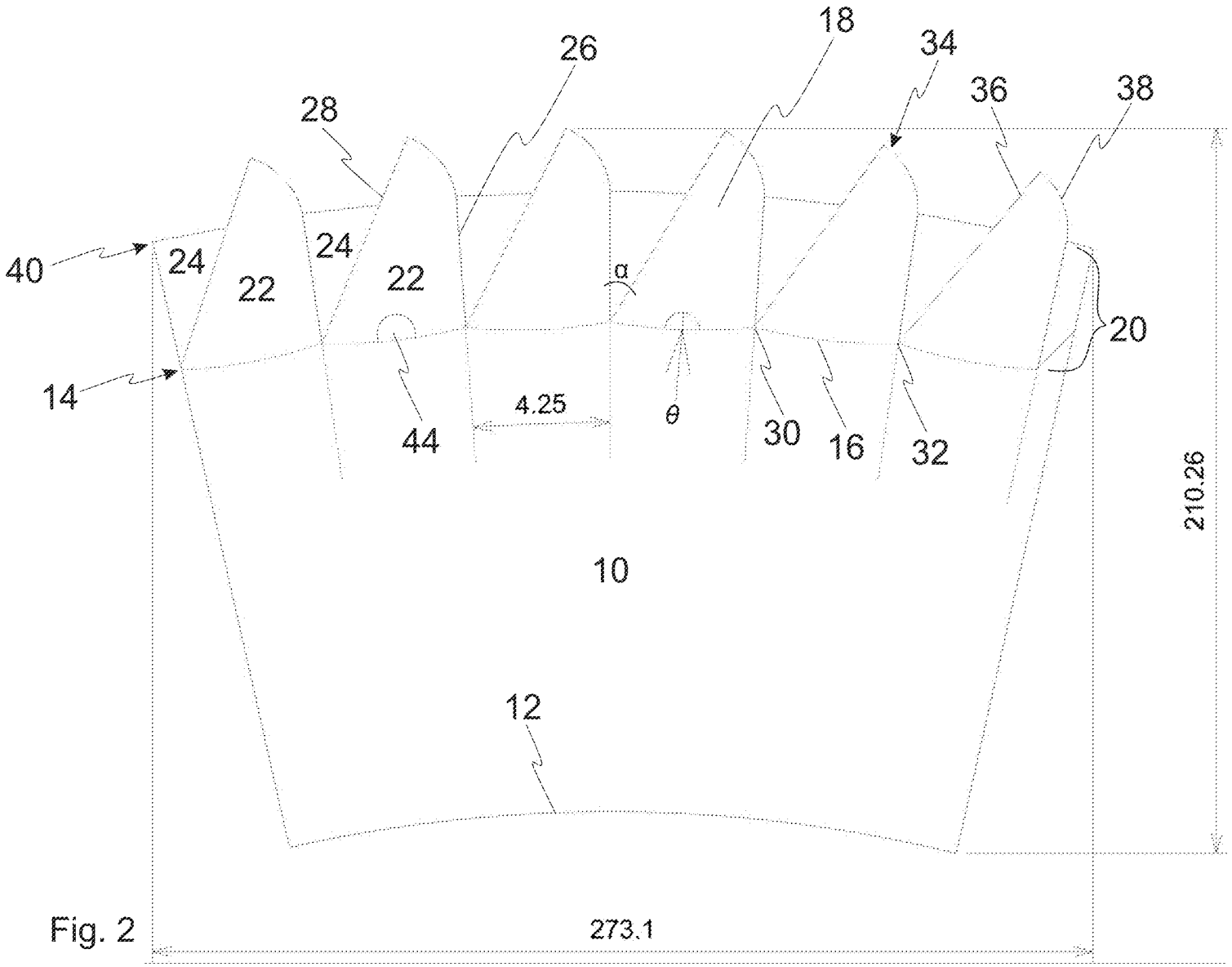
FIG. 2 shows an example of a blank for forming a disposable cup, the blank containing six foldable wings for forming a cover for the cup, and an aperture for drinking in the cover.

The wings may have identical lengths and preferably other dimensions. However, at the third and/or second edges of the blank the farthermost wing or a part limited to it may have a different shape or dimensions, for example as can be seen in FIG. 2.

In one embodiment each of the foldable wings 18 extending form each arc-shaped folding line 16 are partly interconnected at the folding line 14 end forming a continuous area 20, and contain at the continuous area a first folding surface 22 formed by a second folding line 26 and a third folding line 28, the second and the third folding lines extending from the first end 30 and the second end 32 of each arc-shaped folding lines 16 and forming an angle α, such as an angle α of 40-50°, for example about 45°, wherein a tip of a wing 18, which may be is formed at the tapered end of each angle (α), points away from the first folding line 14, and wherein the second folding line 26 and the third folding line 2 are formed to be able to fold to form the cover. Also a and a second folding surface 24 is formed by a second folding line 26 and a third folding line 28 and it is located between the wings. The second and/or the third folding lines may be also called folding bellows.

More particularly the blank may comprise a cardboard sheet designed to be formed into a body of a cup, the blank comprising an edge 12 in a form of a first arc for forming the bottom edge of the cup, a folding line for forming the rim of the cup, wherein the folding line for forming the rim of the cup contains a first folding line 14 formed by a plurality of interconnected arc-shaped folding lines 16 each arcing to the opposite direction than the first arc, wherein a foldable wing 18 extends form each arc-shaped folding line 16, and a plurality of the wings are partly interconnected at the folding line 14 end forming a continuous area 20, and contain at the continuous area a first folding surface 22, and preferably a second folding surface 24, formed by a second folding line 26 and a third folding line 28, preferably the second and the third folding lines extending from the first end 30 and the second end 32 of each arc-shaped folding lines 16, wherein a tip of a wing 18 points away from the first folding line, the tips being configured to be folded towards the center of the formed cup to lock onto each other to form a cover over the opening of the cup. Preferably the second folding line (26) and the third folding line (28) are formed or designed to be able to fold to form the cover. The second folding line and the third folding line may form an angle (α), such as an angle (α) of 40-50°, for example about 45°.

In one embodiment a second folding line of a wing and a third folding line of an adjacent wing meet each other at an end of an arc-shaped folding line.

In one embodiment the continuous area 20 is between the first folding line 14 and a second edge 40, which may be at the opposite end of the blank than the first edge forming the bottom edge of the cup, preferably in a form of an arc which is substantially parallel to the first folding line, wherein the tips of the wings 18 extend from the second edge 40. More particularly the continuous area may be a form of an arced zone or belt, which may have a height in the range of 100-500 mm, the height being the distance between the first folding line 14 and a second edge 40, i.e. the length in a first direction. The continuous area 20 arcs to the same direction as the edge 12 in the form of a first arc.

In one embodiment the first folding line 14 and a second edge 40 at the opposite end of the blank than the first edge forming the bottom edge of the cup define a continuous area 20 comprising a plurality of second folding lines and third folding lines.

In one embodiment the wings are configured to be locked to each other to form a cover having the center of the cover at a lower level than the rim or the upper edge of the cup, when cup is on an upright position. The lower level refers to a level inside the cup, or a level at the direction of the bottom of the cup. An angle in the range of for example 5-30 degrees, such as 10-30 degrees, may be formed between the locked cover and the plane of the rim. In such locked state the wings point slightly inside the cup or to the direction of the bottom. This can be seen for example in FIG. 6, wherein in the left cup the wings are fully locked and the formed cover has the middle point at a lower level than the level of the rim, i.e. the plurality of interconnected arc-shaped folding lines 14. The cup on the right however has the cover part in an opened or unlocked state so that the wings are above the level of the rim. At this state the cup is not rigid and the content thereof is not covered but may be spilled. On the other hand when pressed at the middle, for example by using the straw inserted in the cup on the right, the wings can be pressed so that they are able to lock into the position showed in the cup on the left.

It was found out that if the blank would contain, instead of the arc-shaped folding lines 16, either straight folding lines or folding lines arcing to an opposite direction, the cover when folded would not form a structure having the center at a lower level than the upper edge of the cup, but the cover structure would be flat or at a single plane, which would result in much weaker cover, and the wings would not be locked or secured properly to each other. This is especially important when liquids are applied into the cup. When the cup is pressed at the sides, which usually happens when a cup is held in hand, the pressure formed in the cup tends to lift the cover and open it. The cover of the embodiments helps suppressing this phenomena.

Figure 3:
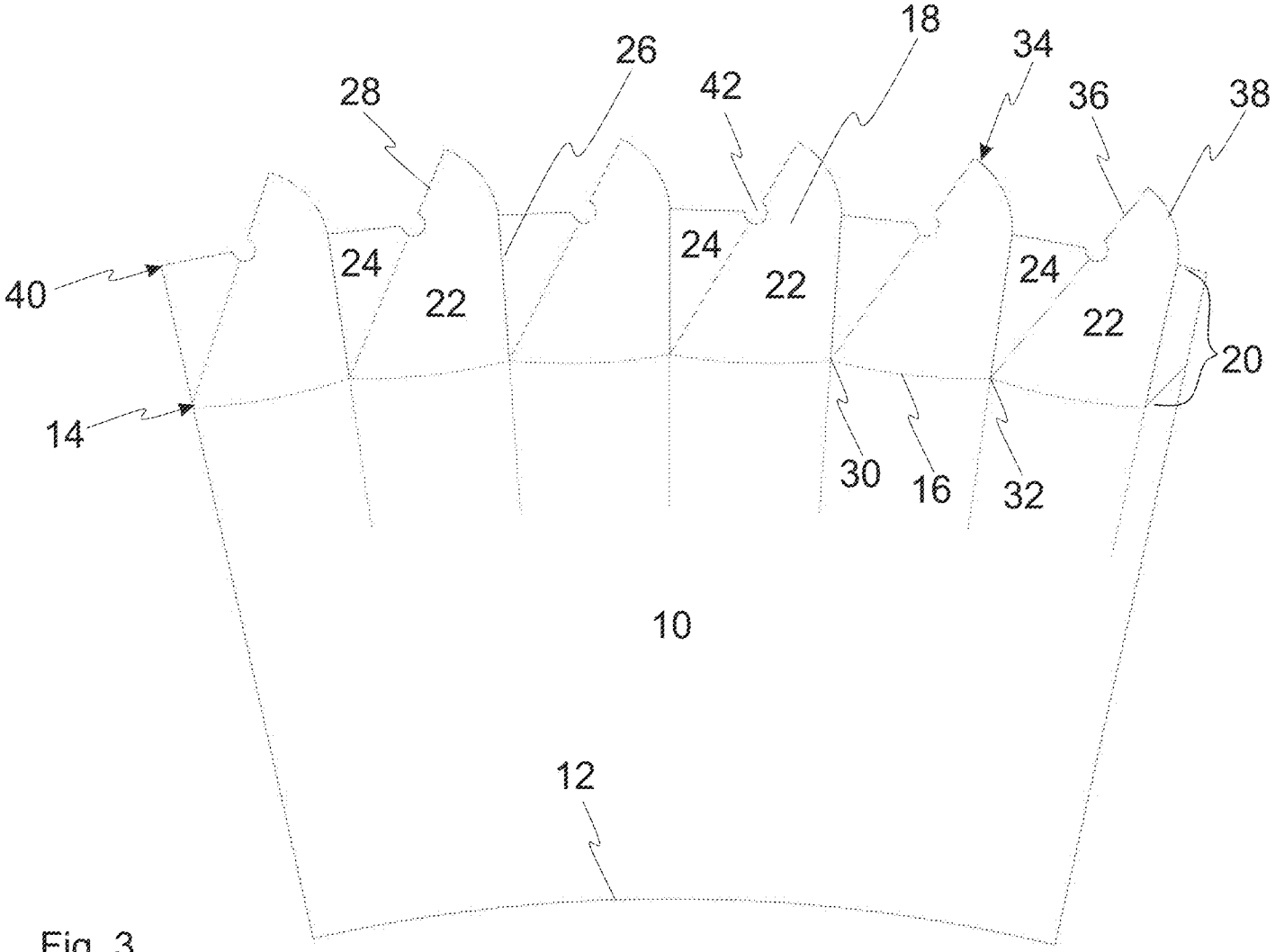
FIG. 3 shows another example of a blank for forming a disposable cup, the blank containing six foldable wings for forming a cover for the cup, and a cut in each wing for forming a straw hole to the cover.
Figure 4:
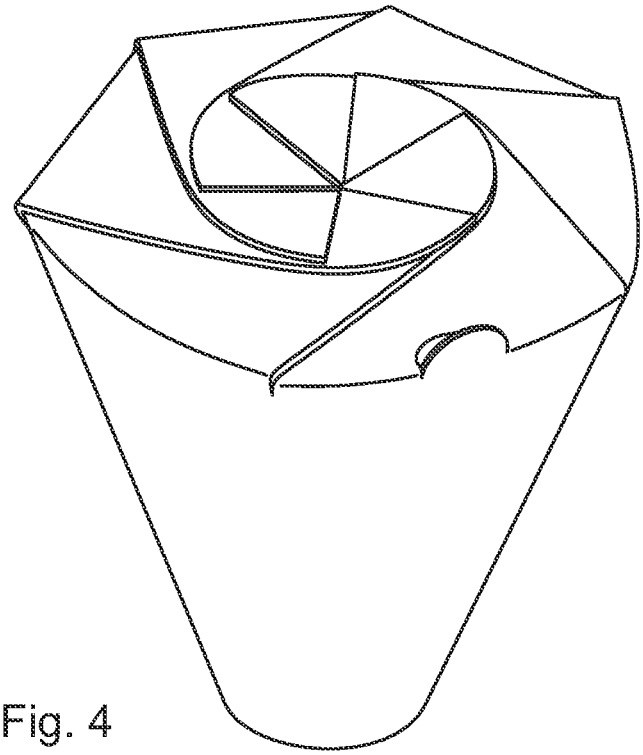
FIG. 4 shows a photo of a prototype made from a blank presented in FIG. 1 and wherein the wings have been folded into a cover.
Figure 5:
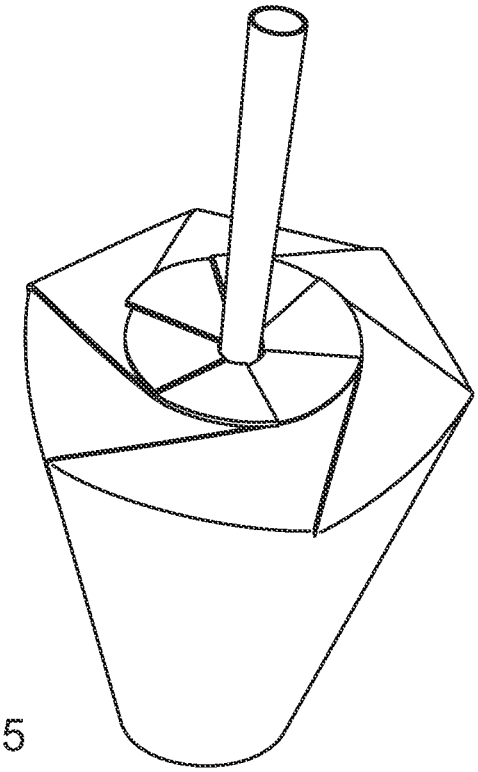
FIG. 5 shows a photo of a prototype made from a blank presented in FIG. 1 and wherein the wings have been folded into a cover and a straw has been inserted into the straw aperture.
Figure 6:
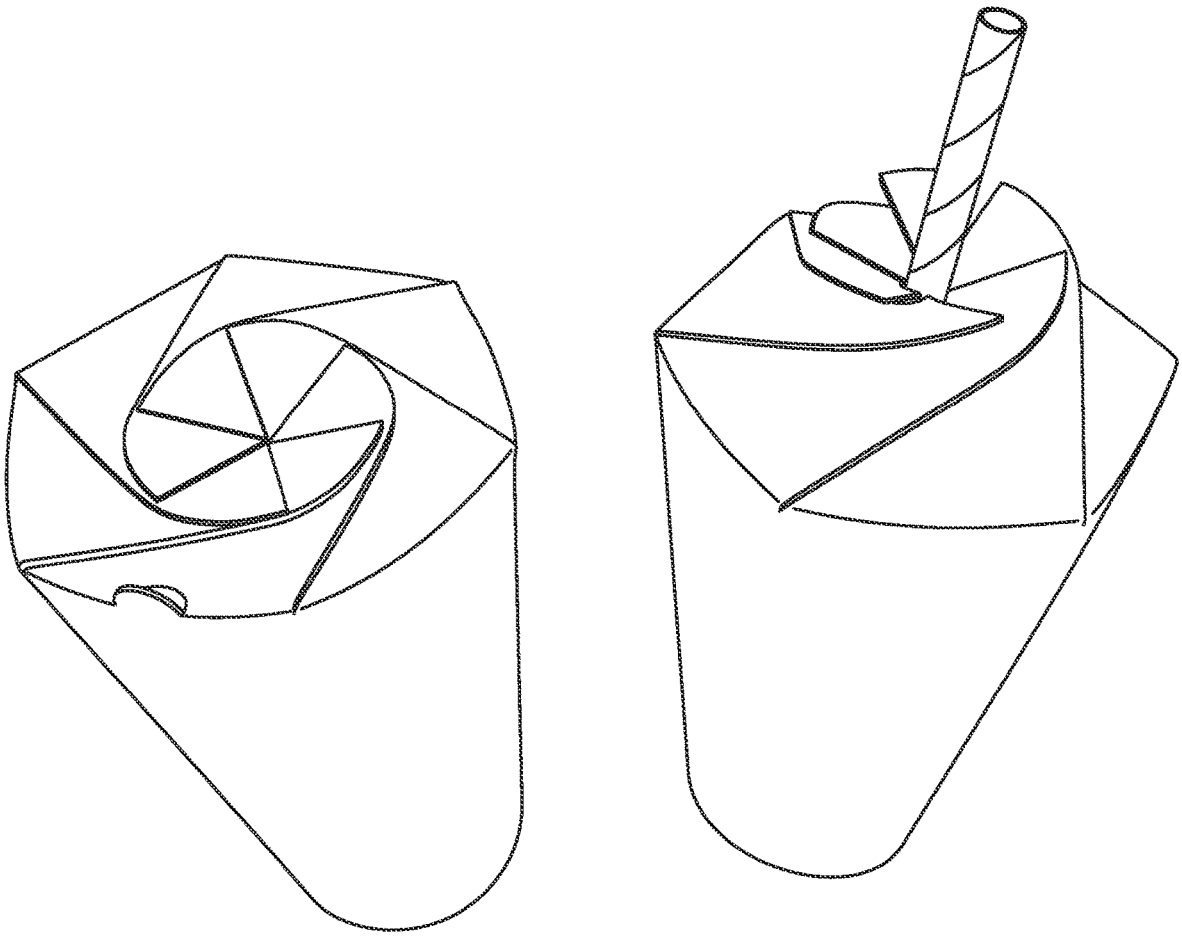
FIG. 6 shows a photo of the prototypes of FIGS. 4 and 5 parallel, wherein the prototype with a straw aperture is not completely folded to show the structure of the cover.

In one embodiment a tip 34 of each wing contains a straight edge 36 and an arced edge 38, the edges forming the tip of the wing. The arced edge arcs away from the wing. The arced edges of the wings form, when folded into the locked position, form a round shape, as can be seen in FIGS. 4-6. In such way no sharp edges are formed in the cover, which could protrude from the plane of the cover. The formed cover is substantially planar so there is a lower risk of accidentally push or tear any protruding parts thus opening the cover, turning over the cup, tearing the cup or the like. Further, the arced side of the tip of the wing supports the wing itself, for example compared to a wing having two straight edges. As seen in FIGS. 4 and 5, the arced edge of a tip of a wing provides a circular structure and therefore a large surface area which is pressed against the folded second edge 40 below, thus reinforcing the locked structure. This is advantageous already when handling the blanks, so the risk of damaging the tips of the wings of the blanks is lower. The straight edge 36 may continue from the third folding line 28 and the arced edge 38 may continue from the second folding line 26 as shown in FIGS. 2 and 3, or vice versa.

The total length of a wing including the extending part and the part at the continuous area, is at least 120% of the length of the wing at the continuous area 20, for example when measured along the straight edge 36 from the first folding line, or when measured from the center of an arc-shaped folding line 16 to the tip of the corresponding wing. In one embodiment the tips of the wings 18 extend from the second edge 40 forming an extending part having a straight edge 36, wherein the total length of a wing including the extending part and the part at the continuous area is at least 120% of the length of the wing at the continuous area 20 when measured along the line continuing from the third folding line 28 to the straight edge 36. Preferably the total length of a wing is at least 140% of the length of the wing at the continuous area, which was found to lock the wings properly even without any support means such as a straw. A total length of 140-180% may be suitable. The length of the wing at the continuous area may be equal to the radius of the rim of the cup or (slightly) longer, such as 100-130% or 100-110% of the radius, for example 101-110%, 101-105% or 102-110%, 102-105%, 105-130%, 105-120% or 110-130% of the radius. In such case two or more of the edges of the continuous area along the line 40 may meet at the center of the cover or the rim. A length of the wing at the continuous area slightly longer than the radius may strengthen the locking of the wings when they are pressed down to lock below the plane of the rim. A length of the wing at the continuous area shorter than the radius may prevent formation of the locking. However, a hole or aperture 42 may be arranged at the center of the cover, so in such case two or more of the edges of the continuous area along the line 40 may not meet exactly at the center.

One embodiment, as shown in FIG. 2, provides a blank 10 for forming a disposable cup, the blank comprising a cardboard sheet designed to be formed into a body of a cup, preferably in a form of a truncated cone, the blank comprising a first edge 12 in a form of a first arc for forming the bottom edge of the cup, a folding line for forming the rim of the cup, wherein the folding line for forming the rim of the cup contains a first folding line 14 formed by a plurality of interconnected arc-shaped folding lines 16 each arcing to the opposite direction than the first arc, and wherein a foldable wing 18 extends form each arc-shaped folding line 16, the wings, preferably tips of the wings, being configured to be folded towards the center of the formed cup to lock onto each other to form a cover over the opening of the cup, wherein each of the foldable wings 18 extending form each arc-shaped folding line 16 are partly interconnected at the folding line 14 end forming a continuous area 20 between the first folding line 14 and a second edge 40 at the opposite end of the blank than the first edge 12, wherein tips of the wings 18 extend from the second edge 40, and each of the foldable wings 18 contain at the continuous area 20 a first folding surface 22 formed by a second folding line 26 and a third folding line 28 which is longer than the second folding line, the second and the third folding lines extending from the first end 30 and the second end 32 of each arc-shaped folding lines 16 and forming an angle ($\alpha$), such as an angle ($\alpha$) of 40-50°, wherein a tip of a wing 18 points away from the first folding line 14, and wherein the second folding line 26 and the third folding line 28 are formed to be able to fold to form the cover, preferably wherein a second folding line of a wing and a third folding line of an adjacent wing meet each other at an end of an arc-shaped folding line, wherein the length of the wing at the continuous area 20 is longer than the radius of the rim of the cup, the length being measured along the third folding line 28, preferably wherein lines along the third folding line 28 and along the second edge 40 meet or cross at the center of the cover or the rim of the cup when folded. In one example the meeting or crossing point is in an aperture for a straw as shown in FIG. 3.

The continuous area 20 between the first folding line 14 and a second edge 40, wherein tips of the wings extend from the second edge, provides a simple folding surface which will be folded below the visible supporting and locking structure, which may be circular, in the formed cup while the tips of the wings form the supporting and locking structure above the cover, as shown in FIGS. 4 and 5. The second edge is moderately arced in general and interrupted by extending tips of the wings. The second edge 40 is folded from the middle at each portion between the extending wings tips, thus forming a reinforcing structure below the circular structure, which reinforcing structure provides pressure to the locked wings and facilitates the locking effect. As the second edge is practically straight, i.e. only moderately arced, at the portion between the wing tips, the folded parts are against each other at the whole length and area therefore fully supporting each other and providing maximum contact against the surfaces against this folded part. As the wings are meant to be locked below the plane of the rim, the wing tips and the folded second edge helps maintaining the cover folded, locked and stable.

In one embodiment the plurality of the interconnected arc-shaped folding lines contain a perforation along the folding line. The perforation may also facilitate the folding of the foldable parts, so one or more the other folding lines may or may not contain perforation. However the perforation may be provided to allow tearing of a part covering the cup. For example it may be desired to remove one or more of the wings or the cover from a cup at some point, so the perforated rim may facilitate this.

The cup, more particularly the cover of the cup or an area at the cover and/or at the rim may contain an aperture, which may contain perforation, for example it is partly or fully formed by perforating, wherein the aperture may be formed as a round aperture or a half-circle or semi-circular/partly circular arc 44, such as shown in FIG. 2. In one embodiment blank for forming a disposable cup comprises an area at one of the interconnected arc-shaped folding lines forming or designed to form an aperture 44 preferably for drinking or pouring from the formed cup. If the aperture, or the arced part of the aperture, is perforated, the user may simply press the area defined by the perforation to form an aperture to the cover or to the cup.

Instead of, or in addition to the aperture described in previous, the cup may contain another aperture for straw, or the aperture described in previous may be designed to act as such aperture. It is possible to design the straw aperture, or strawhole, in such way that inserting the straw will support the cover of the cup.

In one embodiment one or more of the wings, such as all the wings, contain(s) an aperture 42 at one edge, the aperture (s) being arranged to form a straw aperture to a formed cover. An aperture 42 in each wing may have a shape of a semi-circle, wherein the plurality of these partial apertures when combined in the formed cover may form one round or circular full aperture. A cup with a drinking straw in the formed straw aperture if shown in FIG. 5. By selecting a straw aperture smaller than the straw, the straw can be used to support the structure and to secure closed cover. The properties of the cup material, especially elasticity and friction, enable wedging the cover structure with the straw, which further enhances the stability of the covered cup by causing pressure. It was noticed that straws containing cellulosic materials, such as paper straw, cardboard straw or other cellulosic or cellulose-containing straws, which are usually recyclable, compostable and/or biodegradable, provide better locking than plastic straws.

In one embodiment the straw aperture is arranged to have a diameter smaller than the outer diameter of a straw designed to be used with the cup and/or provided with the cup so that the straw can be applied to the aperture manually and the applied straw will cause pressure to the formed cover to support the locking of the wings to each other. The pressure may be directed downwards towards the inside of the cup and/or to sides towards the wings and/or the rim. Straws may be provided in a variety of sizes, especially in a variety of outer diameters, such as 5 mm, 6 mm, 7 mm, 7.2 mm, 8 mm, for example having an outer diameter in the range of 5-13 mm, such as 5-8 mm.

The straw aperture may have a diameter smaller than the outer diameter of the straw to be used, for example 0.1-1 mm smaller, such as 0.2-0.5 mm smaller. In one example the straw aperture has a diameter in the range of 5.5-5.9 mm, which is suitable for a straw with an outer diameter of 6 mm.

The present application provides a disposable cup formed from the blank disclosed herein.

The present application provides a method for preparing a disposable cup, the method comprising providing the blank disclosed herein, forming the blank into a disposable cup.

Forming the blank into a disposable cup may comprise forming the body of the cup, which includes joining the third and fourth edges of the blank together to form the body of the cup. Also a bottom part may be provided and joined to the body to form a cup with a body and bottom, i.e. two-part cup. The "forming" may or may not include forming the cover, so the foldable wings may be left open or initial position, so that the cover is not formed or folded. The cup may be also equipped with one or more handle(s) or other additional parts, which may be joined to the body, for example by using adhesive. In one example the method includes providing one or more parts for forming one or more handle(s) to the cup, and joining the part(s) to the body of the cup. The method may also comprise providing adhesive for joining the third and fourth edges and/or for joining one or more handle(s) or other additional parts to the body. The adhesive may be applied to the blank and/or other joinable part(s), for example as pressure sensitive adhesive or other activatable adhesive, or the adhesive may be applied during forming the cup(s). The adhesive may be applied as a strip of 2-10 mm at one or both edge(s) or parts, preferably overlapping edges or parts, to be joined.

EXAMPLES

Foldable blanks for forming the cups were prepared and cups were formed. The following examples use six foldable wings and either a drinking aperture or a straw aperture, but the teachings of these examples may also be combined or applied to the teachings presented in the previous.

Example 1

A blank shown in FIG. 2 was prepared having an aperture 44 for pouring or drinking. A sheet of coated cardboard was provided and die-cut into a blank having a height of 210.26 mm and a width of 273.1 mm. The blank has an arced edge 12 for forming the bottom of the cup, and an arced folding line 14 for forming the rim or an upper edge of the cup. The folding line 14 is formed by six separate arc-shaped folding lines 16 having a length of 42.5 mm, which are connected together at the ends and form an wavelike folding line, which forms a substantially round upper edge or rim of the cup when the cup is formed, more particularly when the third and fourth edges are joined together to form the body of the cup.

A plurality of wings 18 extend from the folding line 14 for forming the rim of the cup. Each wing contains a part containing a first folding surface 22 defined by second folding line 26 and third folding line 28. Between the individual wings there are second folding surfaces 24, which is also defined by the second folding line 26 and third folding line 28. The first folding surfaces 22 and the second folding surface 24 are connected together at a continuous area or zone 20, and are arranged to be folded to form the cover of the cup, or a part thereof. The second and the third folding lines extend from the first end 30 and the second end 32 of each arc-shaped folding line (16) and form an angle ($\alpha$) of about 45°. The angle $\theta$ of an arc in the arc-shaped folding line (16) is about 0.4 radians.

Each wing further contains an extending part which is not at the continuous area and contains a tip 34 of the wing. These extending parts are configured to be folded to lock to each other and form the center of the cover, while the continuous part forms the parts of the cover extending from the rim or outer edge of the cup, as can be seen in FIG. 4.

The blank was formed into cup by joining the third and fourth ends together and adding and joining a bottom piece to the lower part of the cup with adhesive.

Example 2

A similar blank as described in Example 1 was prepared with the difference that instead of the pouring aperture the blank is designed to form a straw aperture when the cover is formed, as can be seen in FIG. 3. The straw aperture is designed for a straw having an outer diameter of 6.0 mm, so the formed aperture has a smaller diameter of 5.5 mm. Each of the wings contain a partly circular aperture 42 at the point where the second edge 40 and the straight edge 36 and/or the third folding line 28 meet. When the cover is folded and the wings are locked to each other, an aperture for a straw is formed in the middle of the cover. The aperture is designed to receive a straw, and because the aperture has a smaller diameter than the outer diameter of the straw, the inserted straw will push the cover structure down and simultaneously wedges the structure. This reinforces the formed cover and prevents it from unfolding, as shown in FIG. 5. The center of the formed cover is at a lower level than the upper edge of the cup, thus further making the formed cover structure rigid and stable.

The invention claimed is:

1. A blank for forming a disposable cup, the blank comprising a cardboard sheet configured to be formed into a body of the cup, the cup being in a form of a truncated cone, the blank comprising, a first edge in a form of a first arc for forming a bottom edge of the cup, a folding line for forming a rim of the cup, wherein the folding line for forming the rim of the cup contains a first folding line formed by a plurality of interconnected arc-shaped folding lines each arcing to an opposite direction than the first arc, and wherein a foldable wing extends from each arc-shaped folding line, wherein a tip of each foldable wing is configured to be folded towards a center of a formed cup and lock onto each other to form a cover over an opening of the cup, wherein each of the foldable wings extending from each arc-shaped folding line is partly interconnected at a folding line end forming a continuous area between the first folding line and a second edge at an opposite end of the blank from the first edge, the continuous area being in a form of an arc which is substantially parallel to the first folding line, wherein in an unfolded blank, tips of the foldable wings extend from the second edge forming an extending part having a straight edge, wherein a total length of a wing including the extending part and the part at the continuous area is at least 120% of the length of the wing at the continuous area when measured along a line continuing from the third folding line to the straight edge, and each of the foldable wings contain, at the continuous area, a first folding surface formed by a second folding line and a third folding line, the second folding line and the third folding line extending from a first end and a second end of each of the arc-shaped folding lines and forming an angle, such as an angle of 40-50°, wherein a tip of a wing points away from the first folding line, and wherein the second folding line and the third folding line are formed to fold to form the cover, wherein a second folding line of a wing and a third folding line of an adjacent wing meet each other at an end of an arc-shaped folding line.

2. The blank for forming the disposable cup of claim 1, wherein a length of the wing at the continuous area, measured along the third folding line, wherein the third folding line and the second edge meet at the center of the cover or the rim of the cup when folded, is longer than the radius of the rim of the cup.

3. The blank according to claim 2, wherein the length of the wing is 101-110% of the radius.

4. The blank for forming the disposable cup of claim 1, wherein the first folding line and a second edge at the opposite end of the blank from the first edge forming the bottom edge of the cup define a continuous area comprising a plurality of second folding lines and third folding lines.

5. The blank for forming the disposable cup of claim 1, wherein the wings are configured to be locked to each other to form the cover, wherein the center of the cover is at a lower level than the rim of the cup, when the cup is in an upright position.

6. The blank for forming the disposable cup of claim 1, wherein the tip of each wing contains a straight edge and an arced edge, the straight edge and the arced edge forming the tip of the wing.

7. The blank for forming the disposable cup of claim 1, wherein an angle θ of an arc in an arc-shaped folding line of the plurality of interconnected arc-shaped folding lines is one or more of $2\pi/n$ radians or less, less than $2\pi/n$ radians, $2\pi/n*1.1$ radians or less, $2\pi/n*1.2$ radians or less, in the range of $2\pi/n$-$2\pi/n*4$ radians, $2\pi/n*1.1$-$2\pi/n*4$ radians; or $2\pi/n*1.2$-$2\pi/n*4$ radians, wherein n is the number of separate arcs in the first folding line.

8. The blank for forming the disposable cup of claim 1, wherein the plurality of interconnected arc-shaped folding lines contain a perforation along the folding line, the perforation configured to allow for tearing of a part covering the cup.

9. The blank for forming the disposable cup of claim 1, comprising an area at one of the plurality of interconnected arc-shaped folding lines configured to form an aperture for drinking or pouring from the formed cup.

10. The blank for forming the disposable cup of claim 1, the blank being made from recyclable cardboard, including one or more of compostable and biodegradable cardboard.

11. The blank for forming the disposable cup of claim 1, wherein one or more of the wings contains an aperture at one edge, the aperture being configured to form a straw aperture in the formed cover of the formed cup.

12. The blank for forming the a disposable cup of claim 11, wherein the straw aperture is configured to have a diameter smaller than an outer diameter of a straw to be used with the formed cup so that the straw can be applied to the straw aperture manually and the straw, when applied, will cause pressure on the formed cover to support locking of the wings to each other.

13. The blank for forming the disposable cup of claim 12, wherein the straw aperture has a diameter smaller than the outer diameter of the straw to be used.

14. The blank according to claim 13, wherein, the diameter of the straw aperture is one or more of 0.1-1 mm smaller than the outer diameter of the straw, 0.2-0.5 mm smaller than the outer diameter of the straw, or in the range of 5.5-5.9 mm.

15. The blank for forming the disposable cup of claim 1, wherein a number n of the plurality of interconnected arc-shaped folding lines is in the range of 4 to and including 10.

16. A disposable cup formed from the blank of claim 1.

17. A method for preparing a disposable cup, the method comprising providing the blank of claim 1, and forming the blank into the disposable cup.

* * * * *